US007178264B2

(12) United States Patent
Kim

(10) Patent No.: US 7,178,264 B2
(45) Date of Patent: Feb. 20, 2007

(54) WASHING MACHINE WITH A DRYING DEVICE

(75) Inventor: Kyung Hag Kim, Seoul (KR)

(73) Assignee: Daewoo Electronics Corporation, Seoul (KR)

( * ) Notice: Subject to any disclaimer, the term of this patent is extended or adjusted under 35 U.S.C. 154(b) by 0 days.

(21) Appl. No.: 11/127,137

(22) Filed: May 12, 2005

(65) Prior Publication Data

US 2005/0252029 A1 Nov. 17, 2005

(30) Foreign Application Priority Data

May 12, 2004 (KR) ..... 10-2004-0033526

(51) Int. Cl.
*F26B 11/02* (2006.01)

(52) U.S. Cl. ..... 34/596; 34/604; 34/602

(58) Field of Classification Search ..... 34/604, 34/602, 596, 318, 595, 132; 68/20, 19.2, 68/139, 207
See application file for complete search history.

(56) References Cited

U.S. PATENT DOCUMENTS 5,983,520 A * 11/1999 Kim et al. ..... 34/261
6,360,392 B1 3/2002 Malchow

FOREIGN PATENT DOCUMENTS

DE 4002809 1/1991

* cited by examiner

*Primary Examiner*—Kenneth Rinehart
(74) *Attorney, Agent, or Firm*—Bacon & Thomas, PLLC

(57) ABSTRACT

A washing machine includes a water tub for accommodating wash water therein; a drum rotatably installed in the water tub; and a drying device for supplying hot air into the drum. The drying device includes a blower unit for forcing air to flow; a hot air supply duct for generating the hot air, the hot air supply duct having a heater therein and being connected to the blower unit; and at least one hot air jetting portion for jetting the hot air generated by the hot air supply duct into the drum, each of the hot air jetting portions having a hot air supply line for guiding a flow of the hot air and a plurality of nozzles connected to the hot air supply line to communicate with the hot air supply line.

4 Claims, 12 Drawing Sheets

WASHING MACHINE WITH A DRYING DEVICE

FIELD OF THE INVENTION

The present invention relates to a washing machine; and, more particularly, to a washing machine with a drying device capable of improving drying efficiency by supplying hot air with a high speed into a drum of the washing machine uniformly.

BACKGROUND OF THE INVENTION

In general, washing machines are classified into two types: drum type and pulsator type. As for a drum type washing machine, washing of laundry is performed through drop movements of the laundry as a result of rotating a rotary drum accommodating the laundry therein. In a pulsator type washing machine, on the other hand, washing of the laundry is done by using a friction of water currents generated by rotating a pulsator disposed in a bottom portion of the rotary drum.

Recently, there is an increasing demand for the drum type washing machine because it has many advantages compared to the pulsator type washing machine. For example, by configuring the washing machine as drum type, its capacitance can be greater and the phenomenon of the laundry being entangled with each other can be reduced.

FIG. 1 shows a schematic perspective view of a conventional drum type washing machine and FIG. 2 illustrates a schematic longitudinal cross sectional view thereof. The conventional drum type washing machine includes an approximately box-shaped housing 1; a water tub 2 horizontally or slantingly installed inside the housing 1, for accommodating wash water therein; a rotary drum 3 rotatably installed inside the water tub 2 and provided in its cylindrical portion with a plurality of drum perforations; and a driving motor 4 for rotating the rotary drum 3 to perform a washing and a water-extraction of the laundry.

Formed in front portions of the water tub 2 and the rotary drum 3 are openings through which laundry is loaded into or unloaded from the rotary drum 3. Further, a door 5 is hinged on a front surface of the housing 1 to open or close the opening of the water tub 2. Further, the rotary drum 3 is provided on an inner surface of the cylindrical portion thereof with a plurality of agitation blades 6 that are arranged at a predetermined interval. When the rotary drum 3 rotates, the laundry loaded in the rotary drum 3 is lifted up by the agitation blades 6 and then drops upon reaching a certain height. As these agitation movements are repeated, the laundry is washed.

Installed in an upper portion of the housing 1 are a water supply hose 7 for supplying wash water into the water tub 2 and a detergent dispenser 8 for supplying a detergent to be dissolved in the wash water. Further, a water drain pump 9 for discharging the wash water from the water tub 2 externally is installed in a bottom portion of the housing 1.

Moreover, installed above the water tub 2 is a drying device 20 for drying the laundry by blowing hot air to the laundry in the rotary drum 3. Both end portions of the drying device 20 are connected to communication holes 11 and 12 provided in a front side and a rear side of the water tub 2, respectively. Further, a water jetting nozzle 13 is disposed in a rear portion of the water tub 2 to cool down and dehumidify damp hot air containing therein a great amount of moisture that has evaporated from the laundry while the air flows through the rotary drum 3 thereby making a low-temperature air with low humidify. The air that has passed by the water jetting nozzle 13 is blown into an air flow duct 30 by a rotation of fan 21 and heated by a heater 25 installed inside the air flow duct 30. Then, thus heated high-temperature dry air is redirected into the rotary drum 3.

In this conventional drum type washing machine, however, the hot air for drying the laundry is supplied from the drying device 20 in a direction from the upper portion of the rotary drum 3, on which the air flow duct 30 is installed, toward the lower portion thereof, as illustrated in FIG. 2. And drying hot air is buoyant. So the drying hot air supplied into the rotary drum 3 tends to flow through the upper portion of the rotary drum 3 without contacting the laundry gathered in the lower portion thereof and is discharged from the rotary drum 3 through the drum perforations. Accordingly, the drying of the laundry would become incomplete and drying efficiency would be greatly deteriorated because most of the dry hot air is discharged through the upper portion of the rotary drum without being circulated inside the rotary drum 3 uniformly.

SUMMARY OF THE INVENTION

It is, therefore, an object of the present invention to provide a washing machine with a drying device capable of supplying dry hot air into a rotary drum uniformly at a high speed.

In accordance with the present invention, there is provided a washing machine including: a water tub for accommodating wash water therein; a drum rotatably installed in the water tub; and a drying device for supplying hot air into the drum, the drying device including: a blower unit for forcing air to flow; a hot air supply duct for generating the hot air, the hot air supply duct having a heater therein and being connected to the blower unit; and at least one hot air jetting portion for jetting the hot air generated by the hot air supply duct into the drum, each of the hot air jetting portions having a hot air supply line for guiding a flow of the hot air and a plurality of nozzles connected to the hot air supply line to communicate with the hot air supply line.

BRIEF DESCRIPTION OF THE DRAWINGS

The above and other objects and features of the present invention will become apparent from the following description of preferred embodiments given in conjunction with the accompanying drawings in which.

DETAILED DESCRIPTION OF PREFERRED EMBODIMENTS

Figure 1:
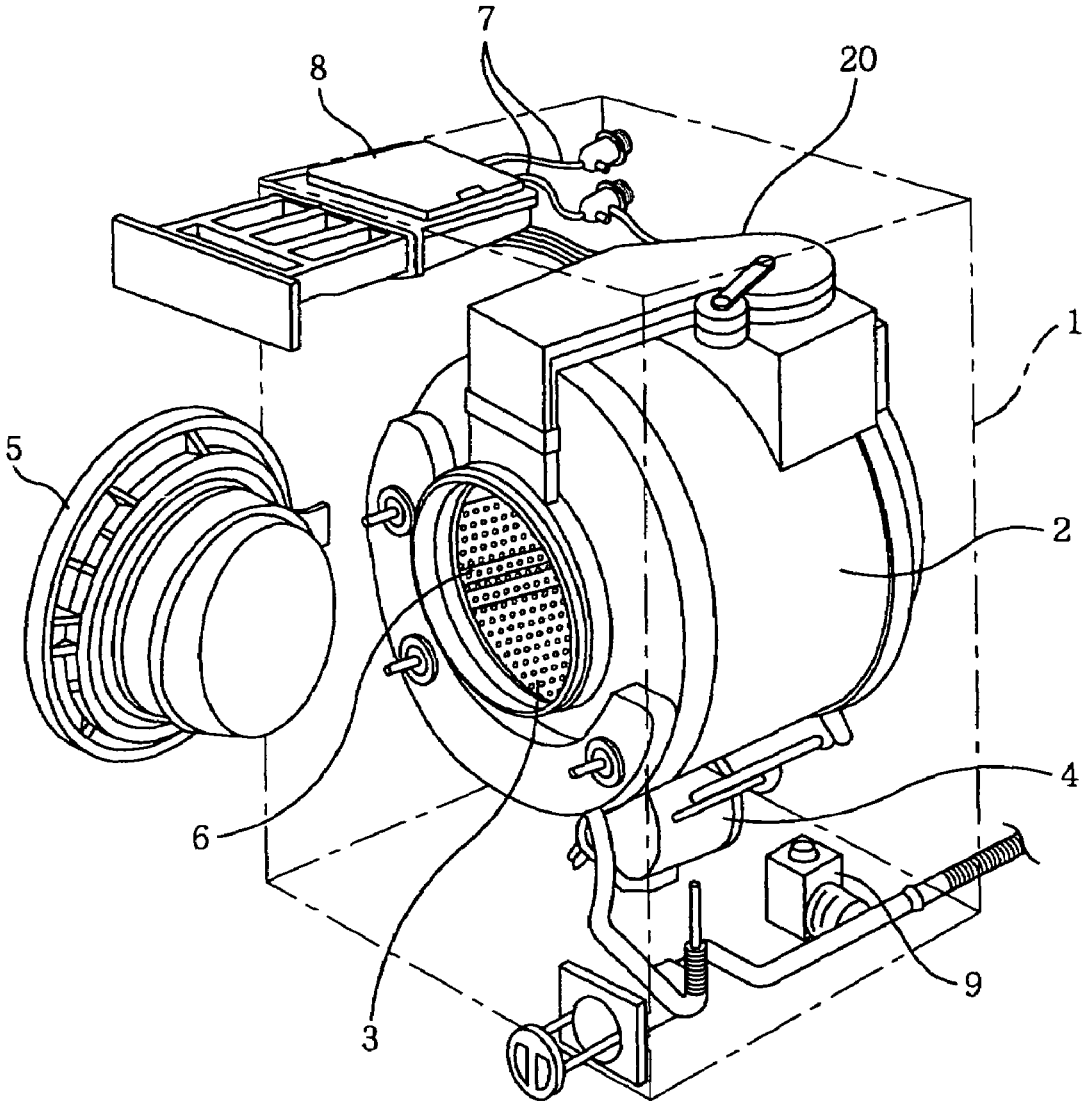
FIG. 1 (PRIOR ART)
FIG. 1 shows a schematic perspective view of a conventional drum type washing machine.
Figure 2:
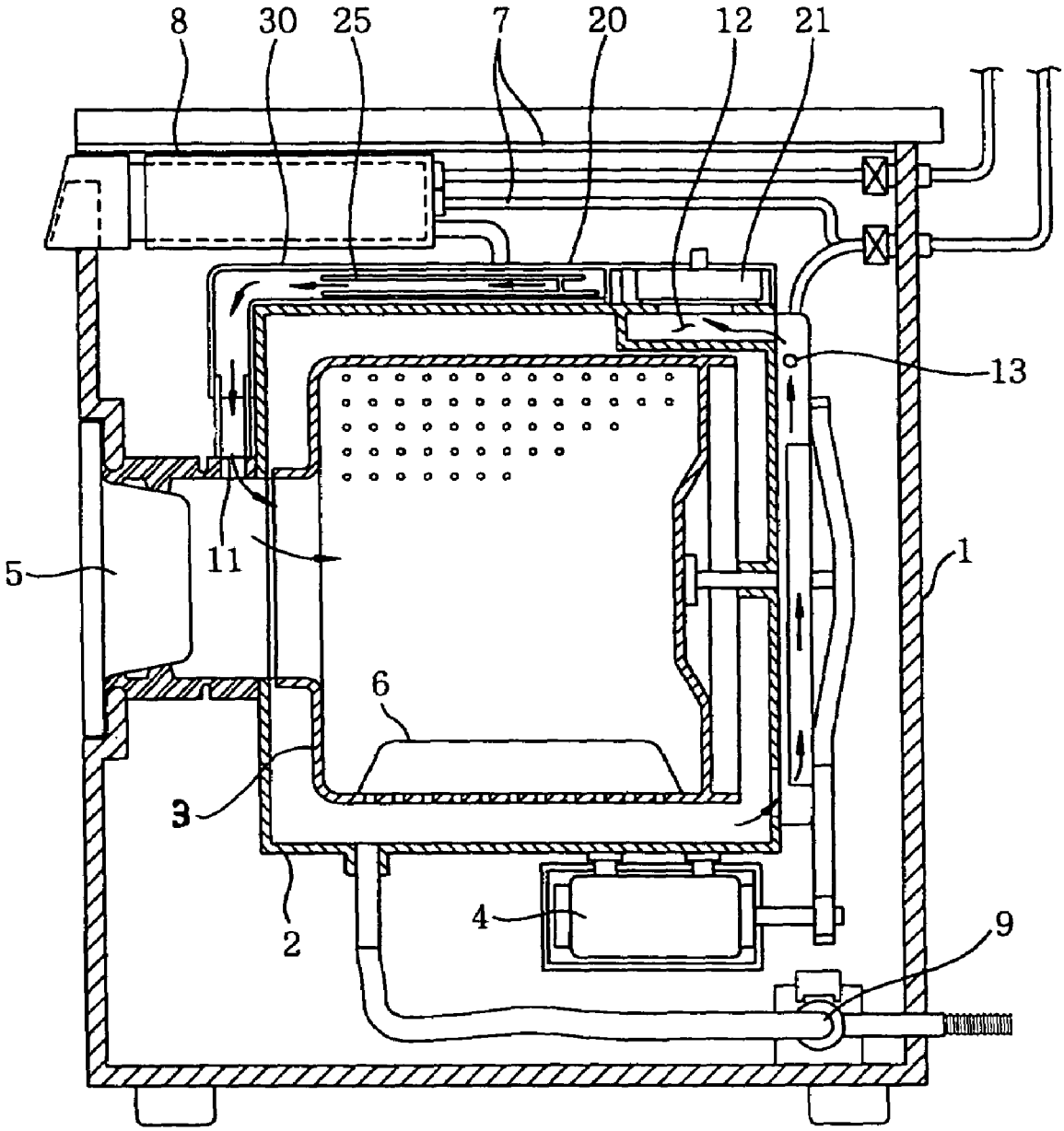
FIG. 2 (PRIOR ART)
FIG. 2 sets forth a schematic longitudinal cross sectional view of the conventional washing machine of FIG. 1.

Hereinafter, preferred embodiments of the present invention will be described in detail with reference to the accompanying drawings, wherein, parts like to those of the conventional washing machine described above will be represented by like reference numerals, and description thereof will be omitted for simplicity.

Figure 3:
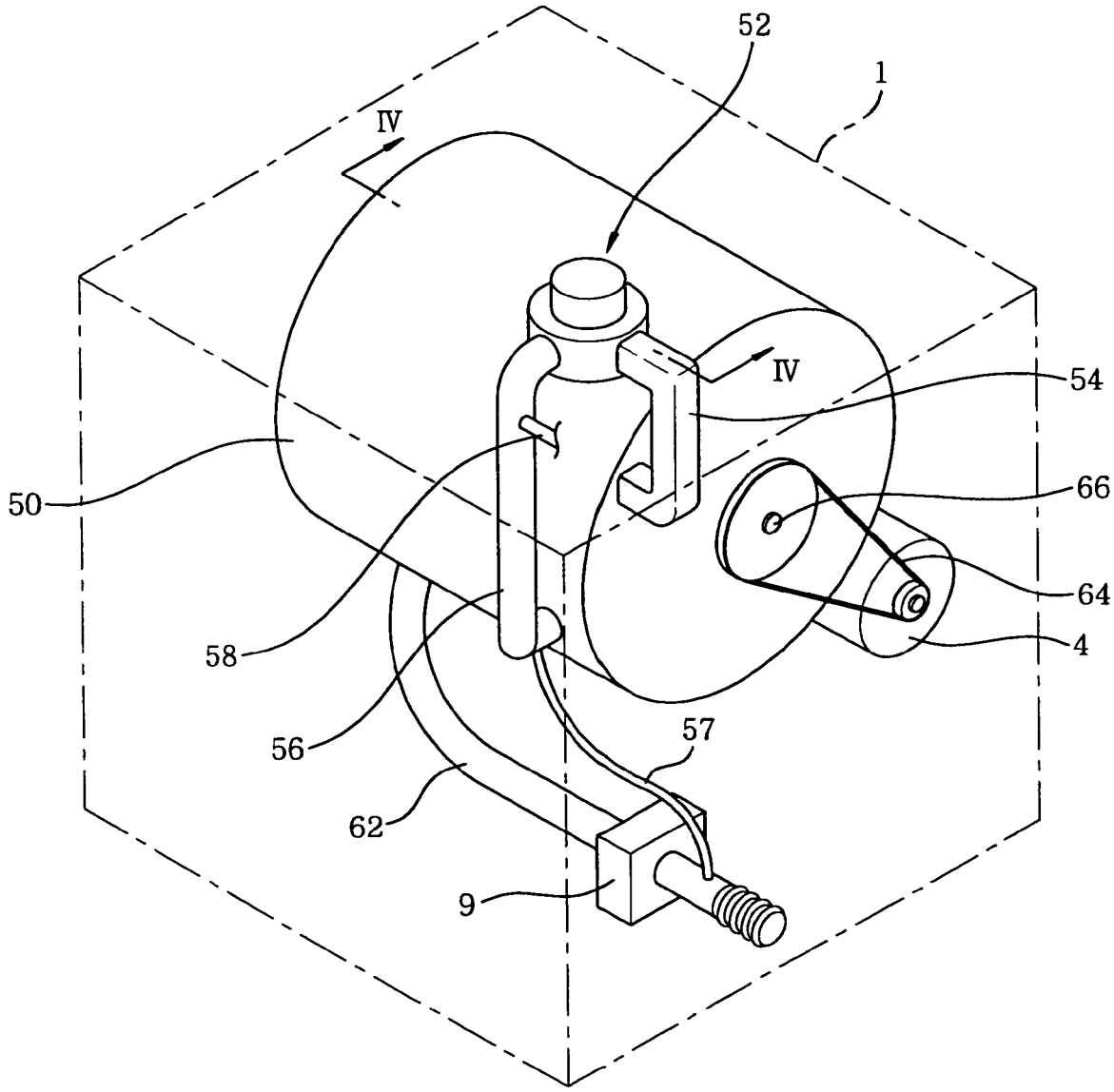
FIG. 3 presents a schematic perspective view of a drum type washing machine with a drying device in accordance with a preferred embodiment of the present invention.
Figure 4:
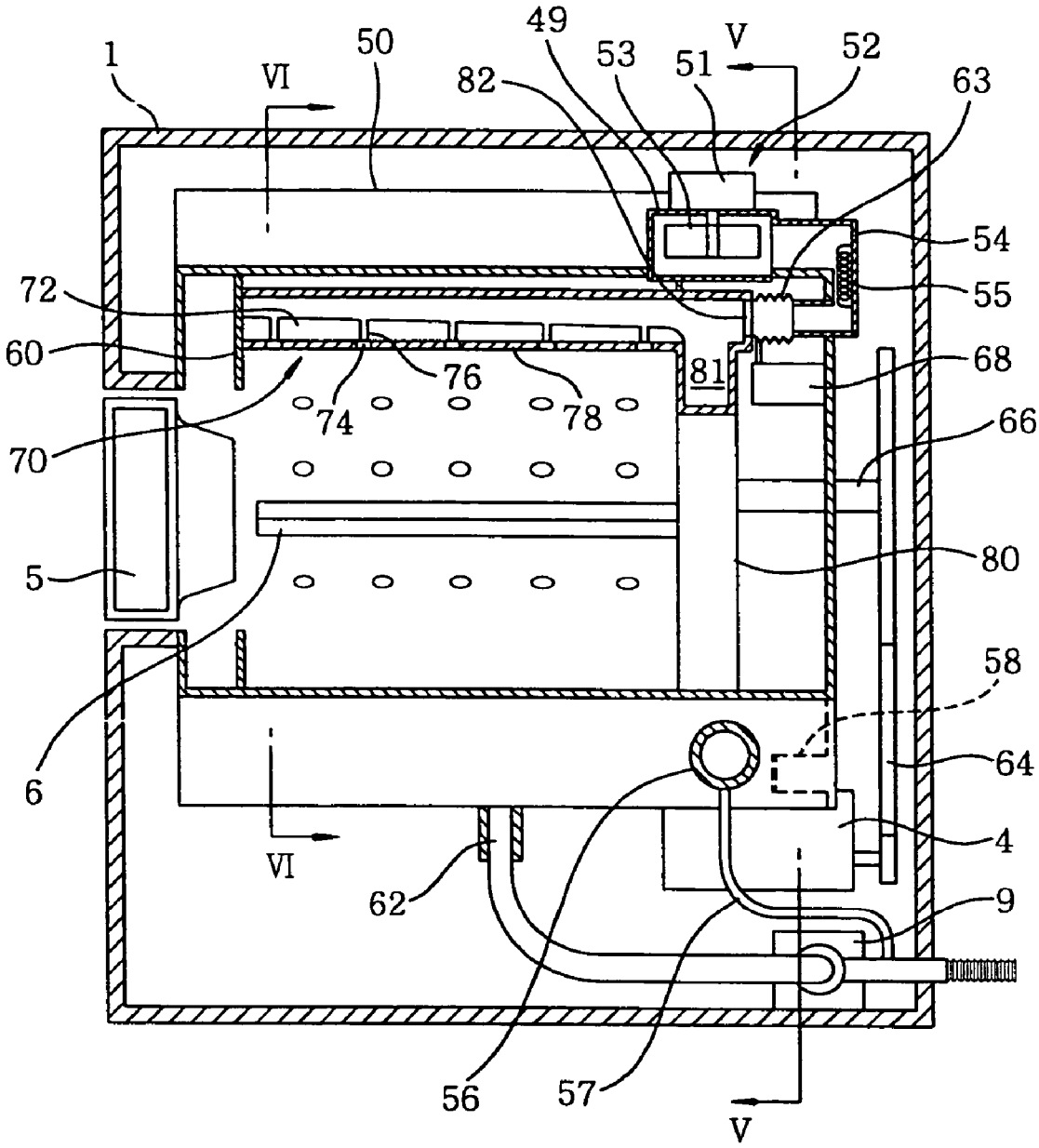
FIG. 4 depicts a schematic cross sectional view of the drum-type washing machine taken along the line IV—IV of FIG. 3.

FIG. 3 shows a schematic perspective view of a drum type washing machine with a drying device in accordance with a first preferred embodiment of the present invention. FIG. 4 is a schematic cross sectional view of the drum type washing machine taken along the line IV—IV of FIG. 3.

The drum type washing machine in accordance with the first preferred embodiment of the present invention includes a water tub 50 installed in a housing 1, for accommodating wash water therein; a drum 60 rotatably installed in the water tub 50, for accommodating laundry therein; a driving motor 4 for rotating the drum 60; and a drying device for supplying hot air into the drum 60 uniformly at a high speed during a drying process.

The drying device of the washing machine in accordance with the first preferred embodiment of the present invention has a blower unit 52 disposed near an upper portion of the drum 60, for forcing air to flow. As shown in FIG. 4, the blower unit 52 includes motor 51, fan 53 and an air flow duct 49 for accommodating the fan 53 therein.

The blower unit 52 communicates with a hot air supply duct 54 for heating the air discharged from the blower unit 52 to make a hot air. The hot air supply duct 54 includes therein a heater 55 for heating the air flowing through the hot air supply duct 54, to thereby obtain hot air. Connected to an outlet side of the hot air supply duct 54 is an extensible/contractible connection line 63 made of a flexible material in a shape of, for example, a bellows.

The connection line 63 is extended or contracted by an actuator 68 formed of, for instance, a gear motor mounted in an inner surface of a rear portion of the water tub 50. The connection line 63 is contracted by the actuator 68 during a washing process so that it does not impede the rotation of the drum 60.

Further, a hot air distribution duct 80 forming a hot air supply passage 81 for guiding the flow of hot air is installed in an outer surface of the rear portion of the drum 60. The hot air distribution duct 80 is provided with air inlet openings 82 (see FIG. 5), each being capable of accommodating therein the outlet side of the connection line 63 inserted thereinto. So if the connection line 63 is extended by the actuator 68 to be hermetically connected to one of the air inlet openings 82 of the air distribution duct 80, the hot air generated from the hot air supply duct 54 can be supplied into the hot air supply passage 81 formed by the hot air distribution duct 80. Further, the hot air distribution duct's 80 portions where the air inlet openings 82 are provided are formed in such a maimer as to protrude further toward the inner surface of the rear portion of the water tub 50 than the other parts of the hot air distribution duct 80.

A plurality of hot air jetting portions 70 (see FIG. 6) for supplying hot air into the drum 60 uniformly at a high speed are installed at a cylindrical portion of the drum 60. Each hot air jetting portion 70 has a hot air supply line 72 which is connected to the hot air distribution duct 80 through the rear portion of the drum 60 to communicate with the hot air distribution duct 80. The hot air supply line 72 is installed in the inner surface of the cylindrical portion of the drum 60, and a plurality of nozzles arranged at a predetermined interval maintained therebetween are connected to the hot air supply lines 72 to communicate therewith. The hot air supply lines 72 and the nozzles 76 are covered by a cover portion 78 with a shape similar to those of the agitation blades 6 provided on the inner surface of the cylindrical portion of the drum 60, so that laundry in the drum 60 is prevented from being caught by the nozzles 76. The cross section of each hot air supply line 72 decreases as it becomes distant from the hot air distribution duct 80. The cover portion 78 has a plurality of air jetting holes 74 formed at positions corresponding to outlets of the nozzles 76 to allow the hot air jetted from the nozzles 76 to be supplied into the drum 60. The hot air uniformly supplied into the drum 60 through the plurality of the hot air jetting portions 70 becomes damp by absorbing moisture from the laundry while it flows through the laundry loaded in the drum 60. Then, the damp air flows out of the drum 60 through a plurality of drum perforations provided in the cylindrical portion of the drum 60.

The damp air discharged from the drum 60 flows into an air exhaust duct 56 connected to a lower portion of the cylindrical portion of the water tub 50. Connected to an upper portion of the air exhaust duct 56 is a dehumidification water supply hose 58. The damp air is cooled down and dehumidified by water sprayed from a nozzle of the dehumidification water supply hose 58 while it passes through the air exhaust duct 56. Then, thus cooled-down and dehumidified dry air from the air exhaust duct 56 is blown into the air flow duct 49 of the blower unit 52 again by a suctioning force generated by the rotation of the fan 53 of the blower unit 52.

Further, coupled to a lower portion of the air exhaust duct 56 is a dehumidification water exhaust hose 57 for discharging the water once sprayed into the air exhaust duct 56 from the nozzle of the dehumidification water supply hose 58 and, also, the water extracted from the damp air.

Figure 5:
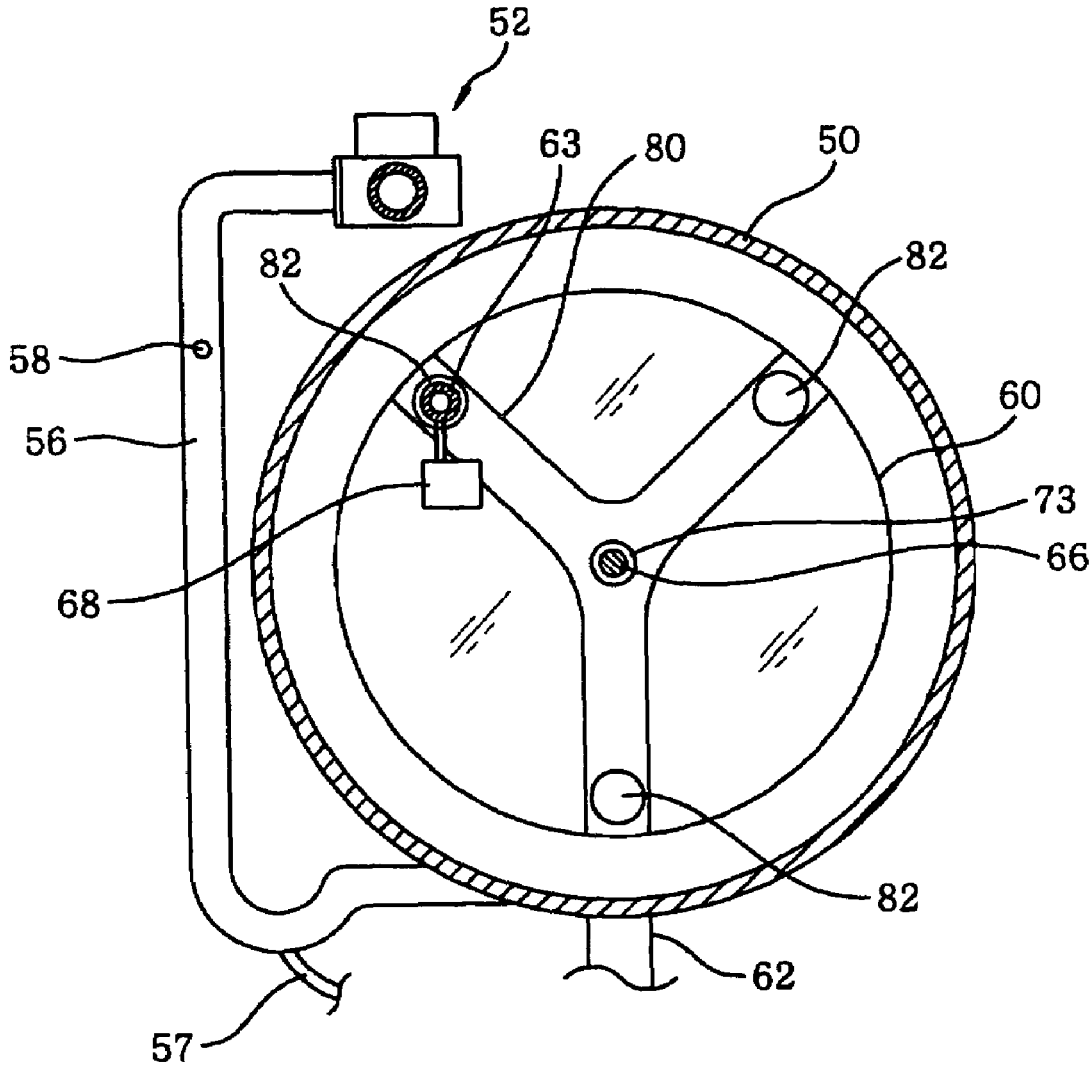
FIG. 5 provides a schematic cross sectional view of major components of the washing machine in accordance with the present invention, taken along the line V—V of FIG. 4.

Referring to FIG. 5, there is provided a schematic cross sectional view of major components of the washing machine taken along the line V—V of FIG. 4. As shown in the figure, the hot air distribution duct 80 disposed in the outer surface of the rear portion of the drum 60 has a Y-shape in which each branch is arranged in an angular interval of 120°. Further, an opening 73 for allowing a rotating shaft 66 to be connected to the outer surface of the rear portion of the drum 60 is provided in the central portion of the hot air distribution duct 80. It is also possible to configure the hot air distribution duct 80 in such a manner that the rotating shaft 66 is connected to the central portion of the hot air distribution duct 80 directly.

As shown in FIG. 5, an air inlet opening 82 is formed at an end portion of each branch of the hot air distribution duct 80, wherein the openings 82 are configured to be connected to the connection line 63 by accommodating the outlet side of the extensible/contractible connection line 63 fitted thereinto. During a drying process of the washing machine, one of the air inlet openings 82 is connected to the connection line 63 while the other two are closed by air inlet opening closing members 69 (see FIG. 7) to be descried later.

Figure 6:
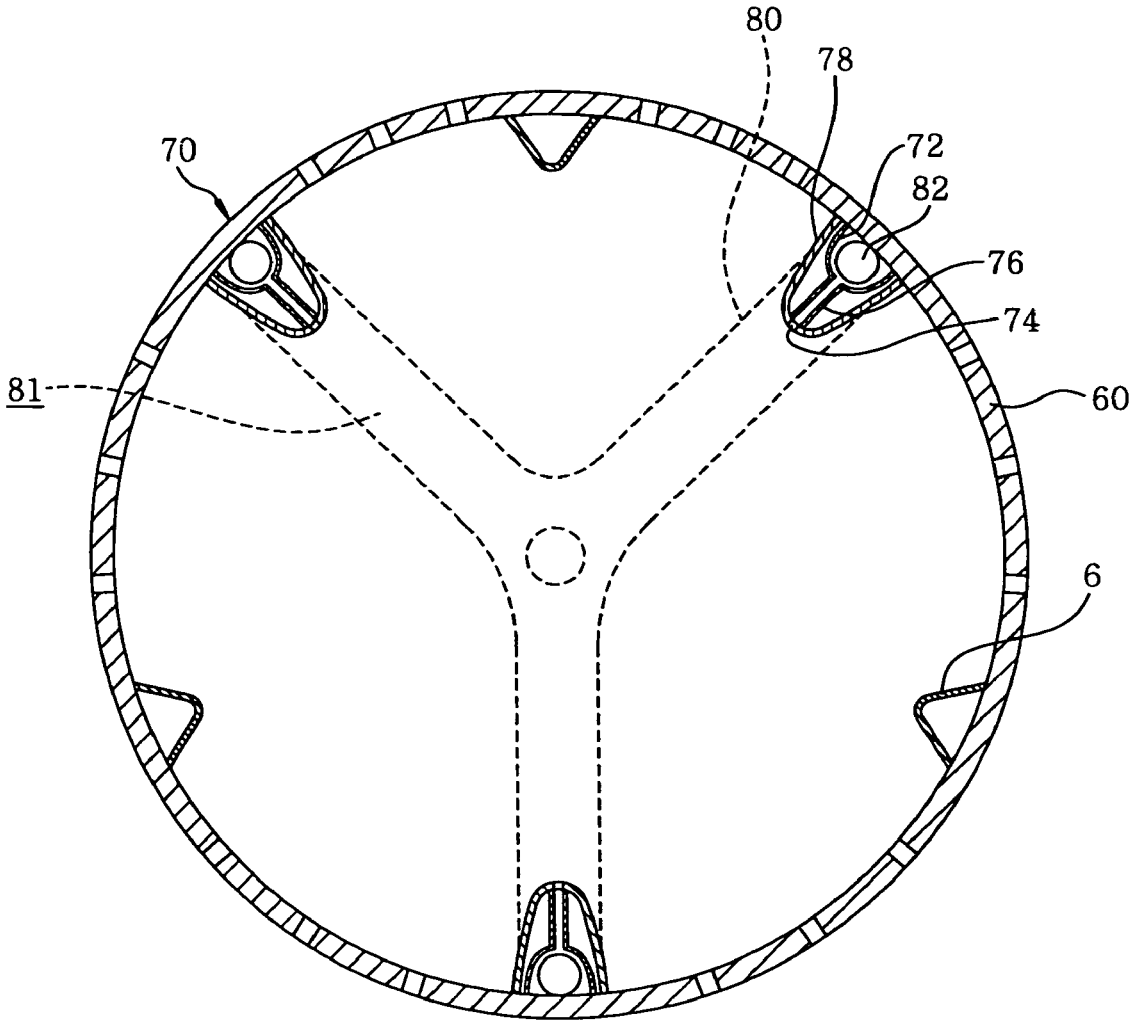
FIG. 6 describes a schematic cross sectional view of the drum taken along the line VI—VI of FIG. 4.

FIG. 6 is a schematic cross sectional view of the drum 60 taken along the line VI—VI of FIG. 4. As shown in the figure, the hot air supply lines 72 of the hot air jetting portions 70 are installed at the inner surface of the cylindrical portion of the drum 60 to provide passageways for allowing the hot air supplied from the hot air distribution duct 80 to flow therethrough. Further, since the shape of the cover portion 78 is nearly similar to those of the agitation blades 6 provided on the inner surface of the cylindrical portion of the drum 60, the cover portion 78 can perform the function similar to that of the agitation blades 6 during the washing process. Moreover, since the plurality of hot air jetting portions 70 are arranged in the drum 60 in the angular interval of 120°, the hot air can be supplied into the drum 60 uniformly.

Figure 7:
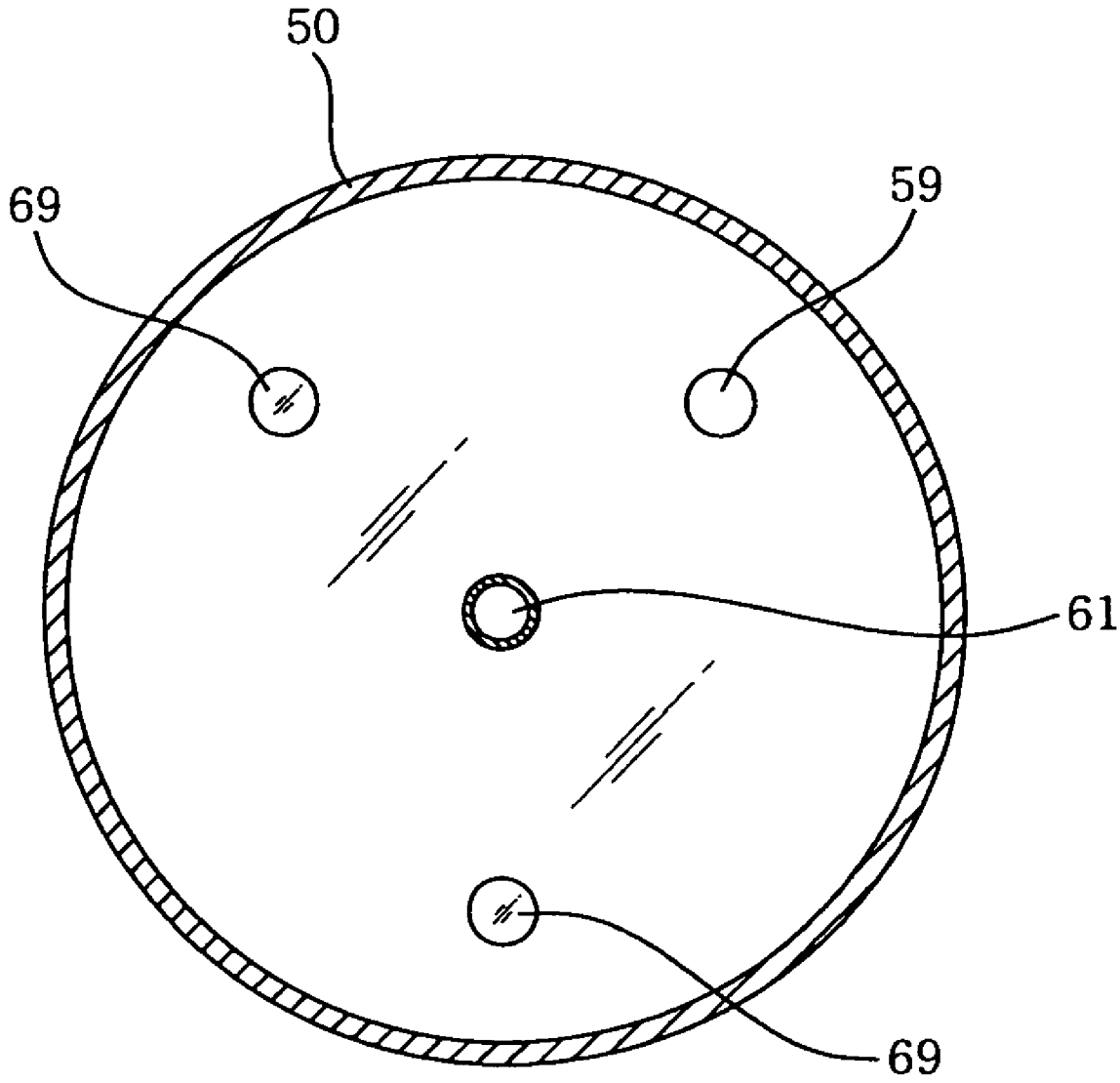
FIG. 7 depicts a schematic cross sectional view of the water tub of the washing machine in accordance with the first preferred embodiment of the present invention.

FIG. 7 is a schematic cross sectional view of the water tub 50 of the washing machine in accordance with the first preferred embodiment of the present invention. As shown in the figure, a duct hole 59 for receiving the hot air supply duct 54 inserted thereinto is provided at an upper right portion of the water tub 50. And the air inlet opening closing members 69 are protruded from the rear portion of the water tub 50 in order to close the other two air inlet openings 82 when the drum 60 is located such that one air inlet opening 82 of the hot air distribution duct 80 overlaps with the duct hole 59 of the water tub 50, i.e., the outlet of the connection line 63 when viewed from the front of the washing machine. The air inlet opening closing members 69 are formed to have their cross sections larger than the diameter of the air inlet openings 82.

Figure 8:
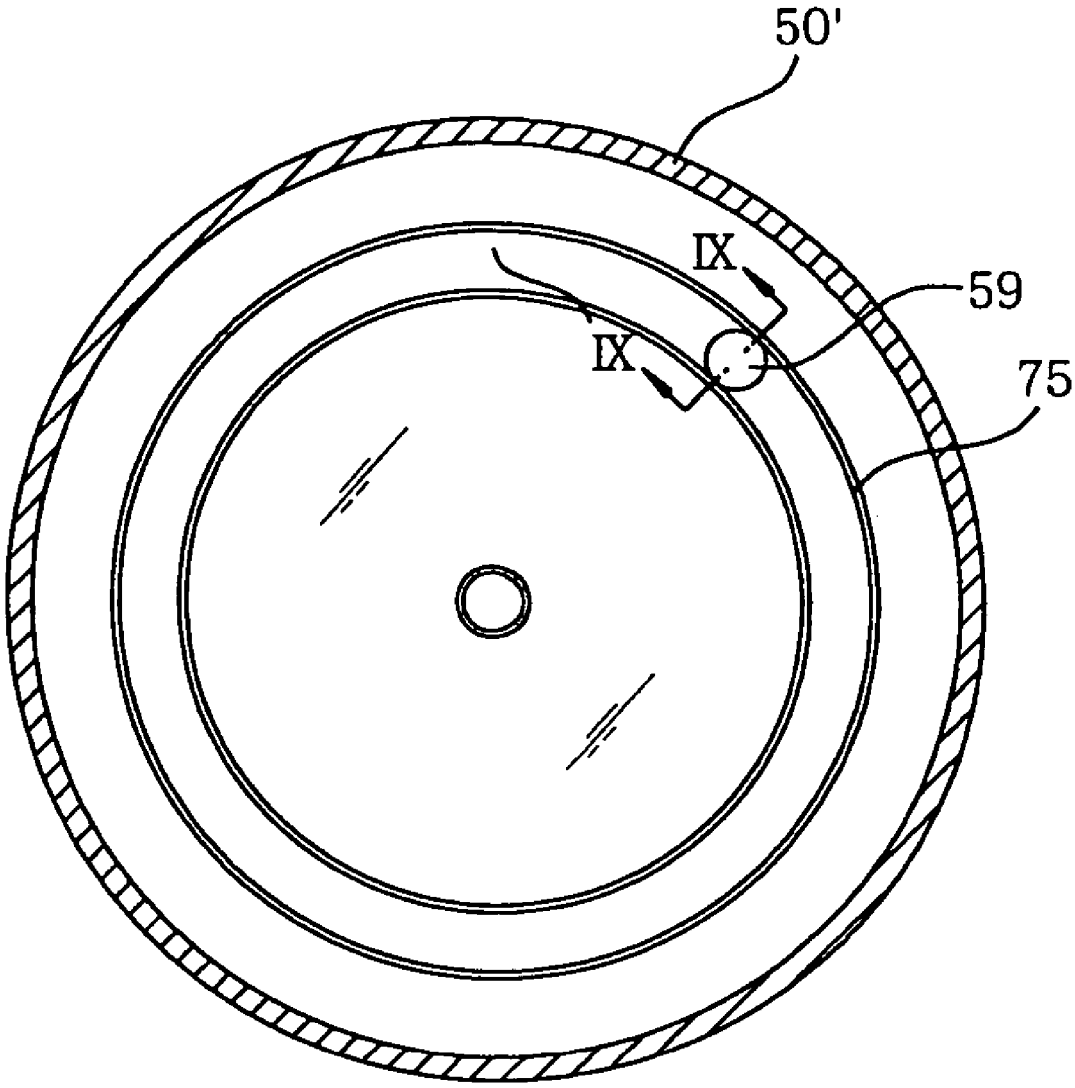
FIG. 8 offers a schematic cross sectional view of a water tub of a washing machine in accordance with a second preferred embodiment of the present invention.

Referring to FIG. 8, there is provided a schematic cross sectional view of a water tub 50' of a drum type washing machine in accordance with a second preferred embodiment of the present invention. The difference between the water tub 50 in FIG. 7 and the water tub 50' in the second embodiment resides in the fact that the water tub 50' has an air inlet opening guide 75 installed at the inner surface of the rear portion of the drum 60 instead of the air inlet opening closing members 69.

Figure 9:
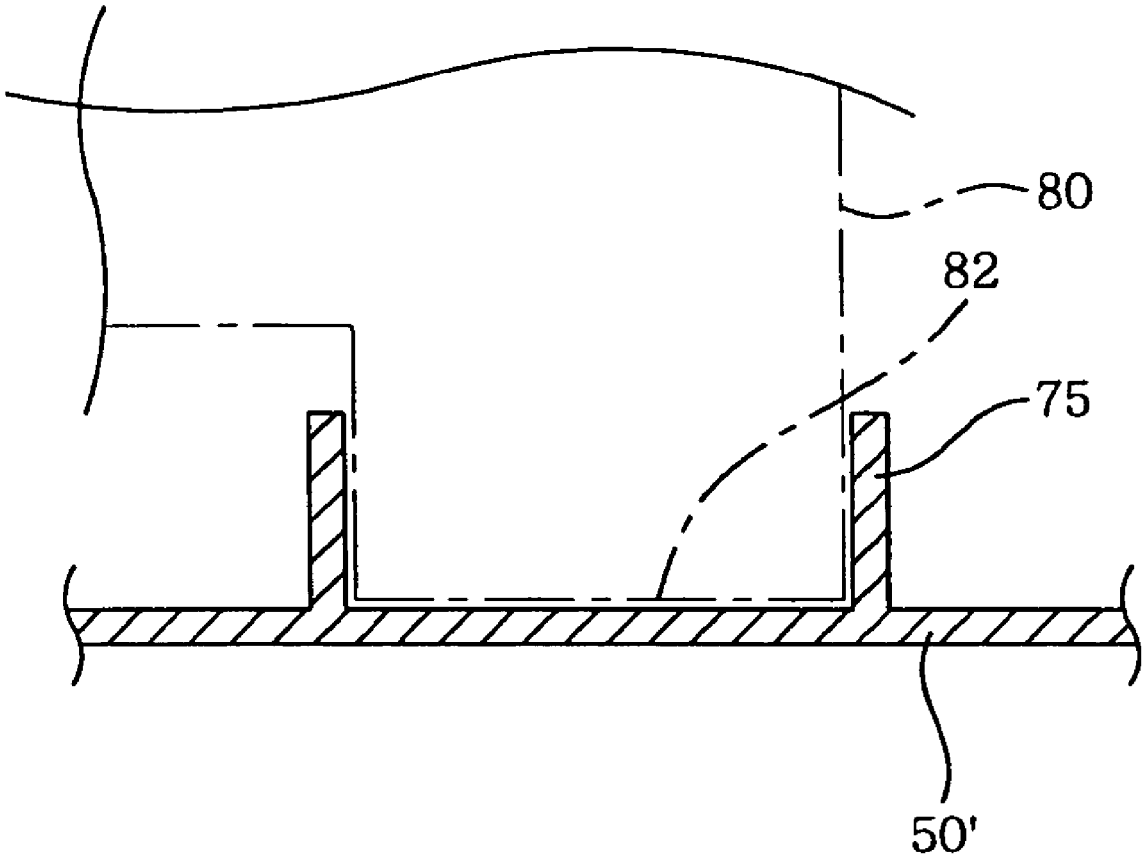
FIG. 9 illustrates a cross sectional view of the air inlet opening guide taken along the line IX—IX for showing a state in which a hot air distribution duct's portion where air inlet opening is formed is inserted into the air inlet opening guide of the washing machine in accordance with the second preferred embodiment of the present invention.

FIG. 9 is a cross sectional view of the air inlet opening guide 75 taken along the line IX—IX of FIG. 8 for showing a state in which the hot air distribution duct's 80 portion where the air inlet opening 82 is formed is inserted into the air inlet opening guide 71 of the washing machine in accordance with the second preferred embodiment of the present invention. As shown in the figure, the hot air distribution duct's 80 portion where the air inlet openings 82 are formed nearly contacts the inner surface of the rear portion of the water tub 50', so that the air inlet openings 82 are almost closed. The hot air supply guide 75 guides the hot air distribution duct's 80 portion where the air inlet openings 82 are formed, while maintaining a minute gap therefrom.

Figure 10:
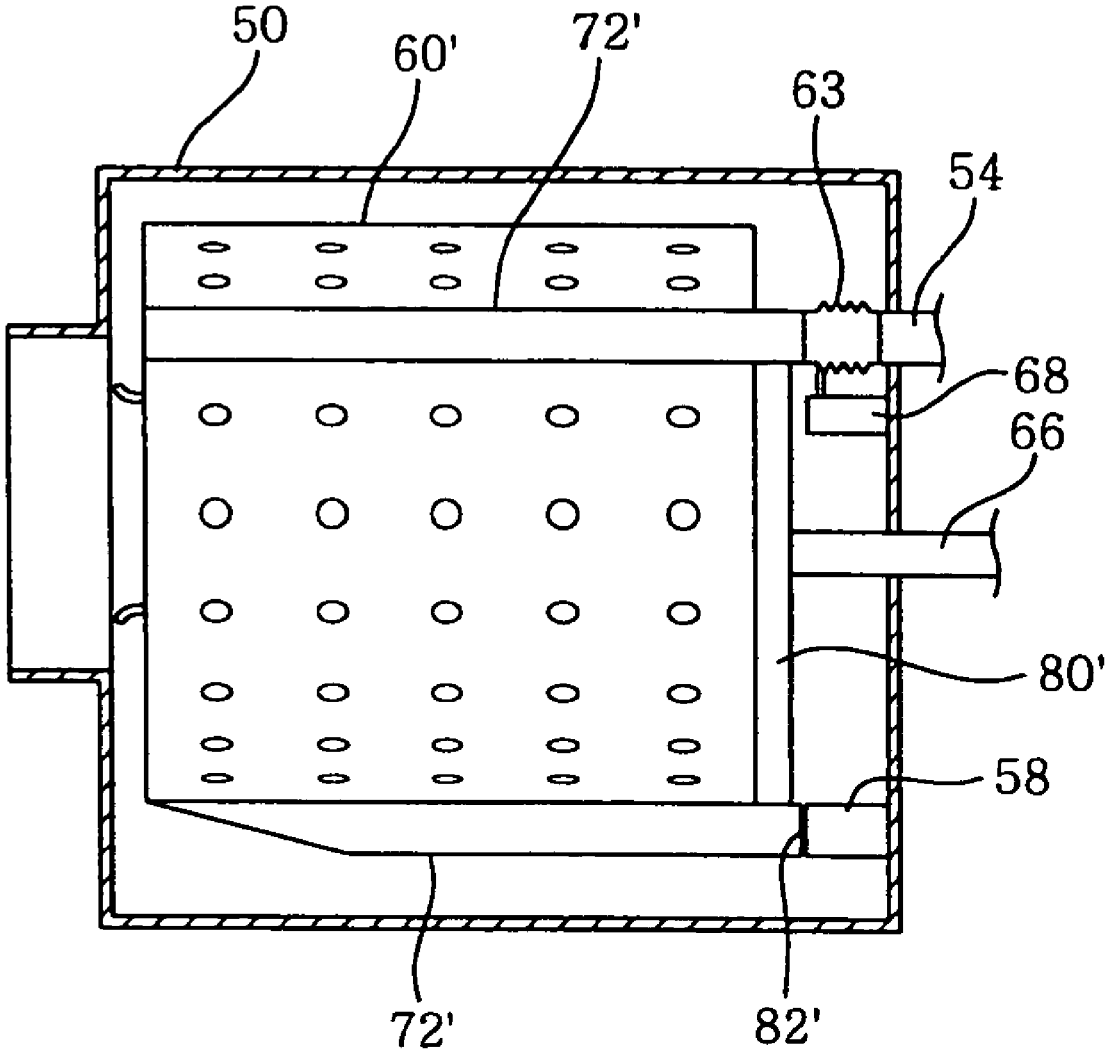
FIG. 10 shows a schematic side view of a drum of a washing machine in accordance with a third preferred embodiment of the present invention.
Figure 11:
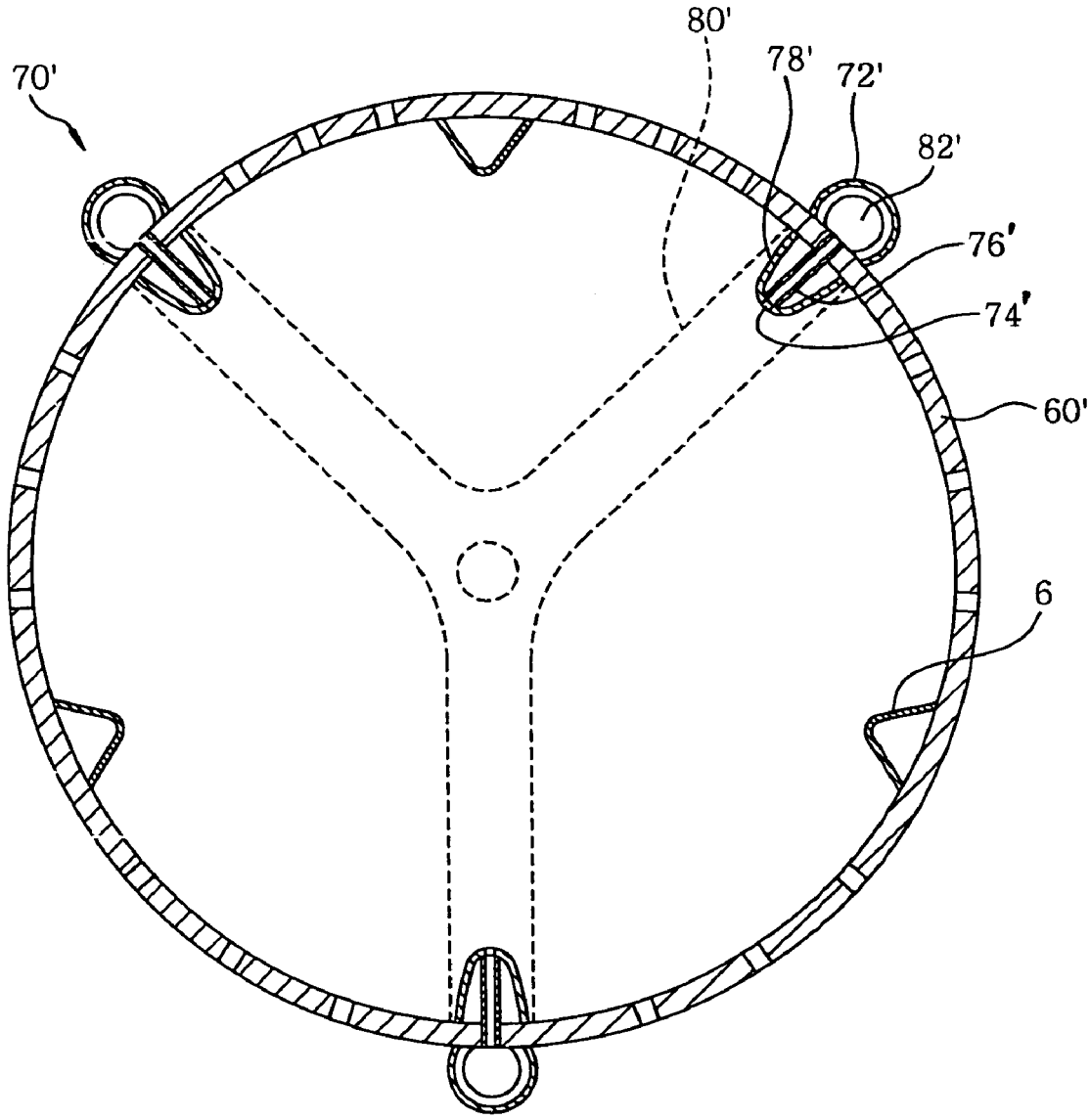
FIG. 11 presents a schematic cross sectional view of the drum of FIG. 10.

FIG. 10 is a schematic side view of a drum 60' of a drum type washing machine in accordance with a third preferred embodiment of the present invention and FIG. 11 presents a schematic cross sectional view thereof. A drying device of the washing machine in accordance with the third preferred embodiment of the present invention differs from the drying device in accordance with the first embodiment of the present invention in that hot air supply lines 72' that communicate with a hot air distribution duct 80' disposed at an outer surface of a rear portion of the drum 60' are installed at an outer surface of a cylindrical portion of the drum 60'. The cross section of each hot air supply line 72' decreases as it becomes distant from the hot air distribution duct 80'. A plurality of nozzles 76' are arranged at a predetermined interval in such a way that they communicate with the hot air supply lines 72' through the cylindrical portion of the drum 60' and a cover portion 78' covers the plurality of the nozzles 76' that protrude inwardly from the inner surface of the cylindrical portion of the drum 60'. The cover portion 78' is provided with a plurality of openings 74' through which the outlets of the nozzles 76' are exposed. Further, the shape of the cover portion 78' is similar to those of agitation blades 6 and the cover portion 78' performs the function similar to that of the agitation blades 6 during the washing process.

Figure 12:
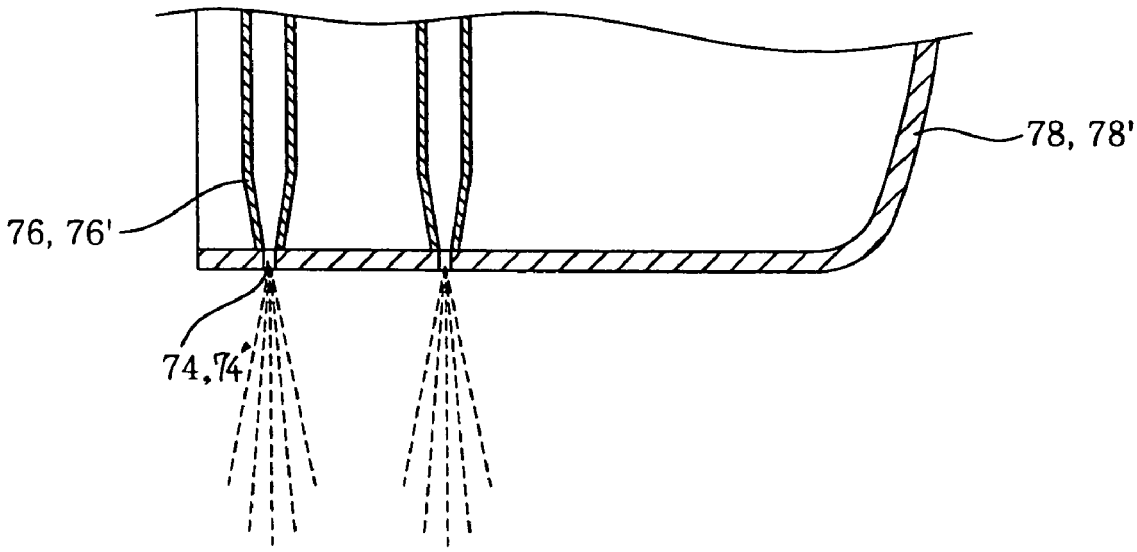
FIG. 12 sets forth an enlarged cross sectional view of nozzles of a hot air jetting portion.

FIG. 12 sets forth an enlarged cross sectional view of nozzles 76 or 76' of the hot air jetting portion 70 or 70', respectively. Since the cross sections of the nozzles 76 or 76' decrease toward the outlets thereof, the velocity of hot air increases while it passes through the nozzles 76 or 76', thus making it possible to supply high-speed hot air into the drums 60 or 60', respectively.

Moreover, more than three hot air jetting portions 70 or 70' can be installed, and, in such a case, the hot air distribution duct 80 or 80' would be configured to have the same number of branches.

Hereinafter, the operation of the washing machine with the above-described configuration in accordance with the preferred embodiment of the present invention will be described.

The washing machine in accordance with the preferred embodiment of the present invention performs a drying process for drying laundry loaded in the drum 60 or 60' after completing a washing and a water-extracting process. The drying process begins with a step of aligning the position of the drum 60 or 60'. That is, one of the air inlet openings 82 of the hot air distribution duct 80 or 80' is aligned to the outlet of the extensible/contractible connection line 63. At this time, a driving motor 4 is controlled by using a sensor (not shown) installed on, for example, the driving motor 4 or the rotating shaft 66.

Thereafter, the connection line 63 is extended by the actuator 68, so that the outlet side of the connection line 63 is inserted into the one of the air inlet openings 82 or 82' of the hot air distribution duct 80 or 80' and is connected thereto hermetically. Then, the motor 51 of the blower unit 52 rotates to direct air into the hot air supply duct 54, and the air introduced into the hot air supply duct 54 is heated by the heater 55 to make the hot air.

The hot air that has flown through the hot air supply duct 54 and the connection line 63 is blown into the plurality of the hot air supply lines 72 or 72' installed on the cylindrical portion of the drum 60 or 60', respectively, after passing through the hot air supply passage 81 formed by the hot air distribution duct 80 or 80'. The hot air supplied into the hot air supply lines 72 or 72' is then directed into the drum 60 or 60' through the nozzles 76 or 76', respectively. At this time, the velocity of the hot air increases while it passes through the nozzles 76 or 76'.

As described earlier, the hot air supplied into the drum 60 or 60' becomes damp as it absorbs moisture from wet laundry in the drum 60 or 60'. Then, the damp air is discharged from the drum 60 or 60' and is directed into the air exhaust duct 56 to become cooled-down dry air by water sprayed into the air exhaust duct 56.

After the above-described hot air supplying step is performed for a predetermined time period, for example, for 4 minutes, the connection line 63 is contracted by the actuator 68. Then, the drum 60 or 60' is rotated by a preset angle, for example, 120 or 380 degrees, and thereafter the connection line 63 is extended again by the actuator 68 to be hermetically connected to one of the air inlet openings 82 or 82' of the hot air supply duct 80 or 80'. As a result of the rotation of the drum 60 or 60', the laundry loaded therein is agitated, so that the drying efficiency can be improved. Further, the operations of the blower unit 52 and the heater 55 can be stopped during the drum rotating step.

If the connection line 63 is reconnected to the one of the air inlet openings 82 or 82' of the hot air distribution duct 80 or 80', hot air is supplied into the hot air supply passage 81 and is blown into the drum 60 or 60' through the hot air supply lines 72 and 72' and the nozzles 76 or 76', respectively.

If the above-described steps are repeated for a predetermined time period, the drying process is completed.

Though the hot air distribution duct 80 has the air inlet opening 82 at each of its braches, it is also possible to form the hot air distribution duct 80 to have only one air inlet opening without having to provide the air inlet opening closing members or the air inlet opening guide on the rear portion of the water tub.

Further, the drying device of the drum type washing machine in accordance with the present invention can also be applied to a pulsator type washing machine.

As described above, the washing machine in accordance with the preferred embodiment of the present invention is capable of supplying high-speed hot air into the drum uniformly, thereby improving the laundry drying efficiency.

While the invention has been shown and described with respect to the preferred embodiments of the present invention, it will be understood by those skilled in the art that various changes and modifications may be made without departing from the spirit and scope of the invention as defined in the following claims.

What is claimed is:

1. A washing machine comprising:

a water tub for accommodating wash water therein;

a drum rotatably installed in the water tub; and a drying device for supplying hot air into the drum, the drying device including:

a blower unit for forcing air to flow;

a hot air supply duct for generating the hot air, the hot air supply duct having a heater therein and being connected to the blower unit; and at least one hot air jetting portion for jetting the hot air generated by the hot air supply duct into the drum, each of the hot air jetting portions having a hot air supply line for guiding a flow of the hot air and a plurality of nozzles connected to the hot air supply line to communicate with the hot air supply line;

wherein a cross section of the hot air supply line decreases as it moves from one end to the other end.

2. A washing machine comprising:

a water tub for accommodating wash water therein;

a drum rotatably installed in the water tub; and a drying device for supplying hot air into the drum, the drying device including:

a blower unit for forcing air to flow;

a hot air supply duct for generating the hot air, the hot air supply duct having a heater therein and being connected to the blower unit; and at least one hot air jetting portion for jetting the hot air generated by the hot air supply duct into the drum, each of the hot air jetting portions having a hot air supply line for guiding a flow of the hot air and a plurality of nozzles connected to the hot air supply line to communicate with the hot air supply line;

wherein the drying device further includes an extendible/contractible connection line connected to an outlet side of the hot air supply duct, and an actuator installed in the water tub for extending or contracting the connection line.

3. The washing machine of claim 2, wherein the number of said at least one hot air jetting portion is more than one, and the drying device further includes a hot air distribution duct installed in a rear portion of the drum, the hot air distribution duct communicating with the plurality of hot air supply lines and being provided with at least one air inlet opening for being connected to the connection line.

4. The washing machine of claim 3, wherein the number of said at least one air inlet opening is more than one, and the drying device further includes one or more air inlet opening closing members disposed in the rear portion of the water tub for closing said at least one air inlet opening except one to be connected to the connection line.

* * * * *